US009561510B2

(12) United States Patent
Snoby et al.

(10) Patent No.: US 9,561,510 B2
(45) Date of Patent: Feb. 7, 2017

(54) SIFTING APPARATUS

(71) Applicants: Richard Snoby, Roswell, GA (US); Andrew C. Snoby, Dahlonega, GA (US)

(72) Inventors: Richard Snoby, Roswell, GA (US); Andrew C. Snoby, Dahlonega, GA (US)

(73) Assignee: SNOBY SEPARATION SYSTEMS, LLC, Dahlonega, GA (US)

( * ) Notice: Subject to any disclaimer, the term of this patent is extended or adjusted under 35 U.S.C. 154(b) by 0 days.

(21) Appl. No.: 14/855,418

(22) Filed: Sep. 16, 2015

(65) Prior Publication Data

US 2016/0354789 A1 Dec. 8, 2016

Related U.S. Application Data

(60) Provisional application No. 62/051,184, filed on Sep. 16, 2014.

(51) Int. Cl.

| | |
|---|---|
| ***B07B 4/00*** | (2006.01) |
| ***B03B 4/00*** | (2006.01) |
| ***B03B 4/06*** | (2006.01) |
| ***B07B 4/08*** | (2006.01) |
| ***B07B 11/04*** | (2006.01) |

(52) U.S. Cl.

CPC ..... *B03B 4/005* (2013.01); *B03B 4/065* (2013.01); *B07B 4/08* (2013.01); *B07B 11/04* (2013.01)

(58) Field of Classification Search

CPC ..... B07B 4/08; B07B 11/04; B03B 4/005; B03B 4/065

USPC ..... 209/473, 474, 475

See application file for complete search history.

(56) References Cited

U.S. PATENT DOCUMENTS

| | | | | |
|---|---|---|---|---|
| 3,852,168 | A * | 12/1974 | Oetiker | B03B 4/02 209/467 |
| 6,467,631 | B2 * | 10/2002 | Strangalies | B03B 4/005 209/474 |
| 7,171,963 | B2 * | 2/2007 | Jagger | A61M 16/101 128/201.21 |
| 9,033,155 | B2 * | 5/2015 | Sorhuus | B03B 4/06 209/250 |
| 9,327,320 | B1 * | 5/2016 | Coolidge | B07B 4/08 |
| 2010/0184861 | A1 * | 7/2010 | Politi | A61J 3/10 514/570 |

* cited by examiner

*Primary Examiner* — Terrell Matthews
(74) *Attorney, Agent, or Firm* — Seyfarth Shaw, LLP; Christopher Baxter; Brian Michaelis

(57) ABSTRACT

A sifting apparatus for stratifying raw material includes a material feed-in device, a material support unit, a gas plenum, and a discharge control device. The material support unit receives material from the material feed-in device and has a surface having a plurality of openings for a gaseous medium introduced from underneath the material support unit, thereby effecting loosening and stratification of the material into a layer of relatively heavier material, and a layer of relatively lighter material atop the heavier material. The introduced gaseous medium originates in a pump, is collected in a pressurized reservoir and is controlled by a metered valve prior to introduction to the material support unit.

18 Claims, 2 Drawing Sheets

SIFTING APPARATUS

CROSS-REFERENCE TO RELATED APPLICATION

This application is based upon and claims the benefit of U.S. Provisional Patent Application No. 62/051,184, filed Sep. 16, 2014, the entire contents of which are incorporated herein by reference.

FIELD

This disclosure relates generally to a sifting apparatus and, more specifically, to a sifting apparatus for preparatory concentration of raw materials including, e.g., raw coal.

BACKGROUND

Sifting or settling apparatuses generally include a material feed device, material support unit with holes through which flows a gaseous fluid, often gas guided by a plenum disposed underneath the material support unit, and a discharge control device for controlling separated discharge of relatively heavier material and relatively lighter material. The inflowing pulsed gas operating to loosen the material fed onto the material support unit stratifies the material into layers of relatively lighter material atop of layers of relatively heavier material. An air sifting apparatus of this type is described, for example, in the publication Schubert "Aufbereitung fester mineralischer Rohstoffe", Band II VEB Deutscher Verlag fuer Grundstoffindustrie, Leipzig, Pages 89 and 90.

Typically, sifting apparatuses, like the one described above, produce a less distinct separation between the heavier and lighter materials when compared with wet sifting machines. To achieve satisfactory sorting results according to the aforementioned apparatus, traditionally multiple factors must be present including, for example, a large density difference between the components of the material. There is always a need for an improved sifting apparatus.

SUMMARY

Sifting apparatuses ("jigs"), whether wet or dry, operate according to two functions: they stratify and then separate. Improved stratification can be achieved when the volume, acceleration, and pulse frequency of the gas or air used in the jigging stroke are each achieved with relative independence. The inclusion of a pressurized reservoir has not been utilized in dry jigging, and thus rapid decompression of the gaseous medium occurs in the gas plenum after each jigging stroke. This disclosure provides a sifting apparatus that offers a solution to the challenge of providing a jig in which the acceleration of the jigging stroke can be improved without excessive pressure loss in the plenum or at the pump discharge point and without deleterious flow change across the material support unit. Stratification can be achieved, and thus the separation will be enhanced, while shock to the pumping device is reduced.

The solution to this challenge is principally comprised of providing a reservoir or at least one reservoir of sufficient size to accept gaseous flow from a pump to build a pressure and relatively large volume that will permit discharge of pulses of relatively smaller volumes as a controlled valve opens and closes, thereby causing flow of gas into the plenum, whereupon the pulsating gas flow is adjusted to a pulse strength sufficient to lift the particles of the material upward and, via the consequent varying distance of fall, thereby effect stratification of the material into relatively heavier material layers and relatively lighter material layers.

One embodiment includes a sifting apparatus having a material support unit having a base with one or more apertures located therethrough; a plenum attached to an underside of the material support unit of e.g., a gravity separator; a gas or air dispenser that is attached to the plenum and in communication with the material support unit, and that provides a pulsating gaseous medium flow to the material support unit; a pump in communication with the dispenser, wherein the pump provides a pressurized medium; a reservoir that maintains a threshold pressure and that is positioned between the pump and the dispenser; and a discharge control in communication with the material support unit and operable to control discharge of a relatively heavier material.

In accordance with embodiments of the jig, the pressure of the pulsating gas flow can also be adjusted by the proper selection of a pump, which will pressurize the reservoir.

Additional features and advantages of the present disclosure are described below. This disclosure may be readily utilized as a basis for modifying or designing other structures, systems, and processes for carrying out the same purposes of the present disclosure. It should also be realized by those skilled in the art that such equivalent implementations do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

The particular features and advantages of the present disclosure will be apparent from the detailed description set forth below in conjunction with the drawings in which like reference characters identify corresponding aspects throughout.

DETAILED DESCRIPTION

Figure 1:
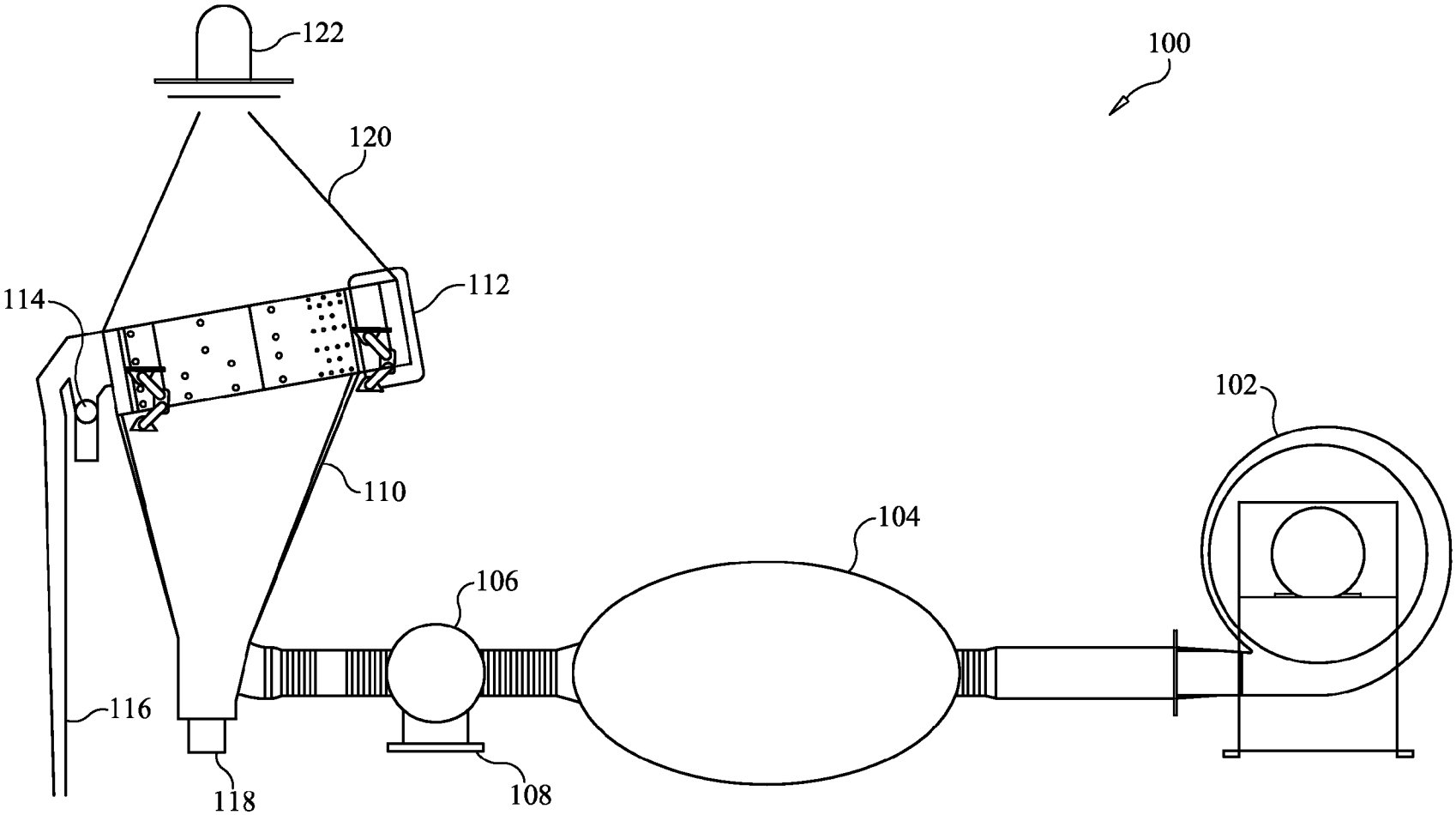
FIG. 1 is a schematic side view of embodiments of a sifting apparatus of the present disclosure having a reservoir.

As shown in FIG. 1, a sifting apparatus or jig 100 may include a pressure build up system including a pump 102 and reservoir 104, a pressure release unit including an adjustable orifice 106 and meter 108, a plenum 110, a material support unit 112, a discharge control 114, a light product discharge channel 116, a heavy product discharge channel 118, a dust collection housing 120, and a material feed-in unit 122. As can be seen from FIG. 1, the arrangement of the pump 102, the plenum 110, and the reservoir 104 may be connected to or incorporated into other traditional gravity separators (e.g., having features such as, a material support unit 112, a light product discharge channel 116, a heavy product discharge channel 118, a dust collection housing 120, and a material feed-in unit 122).

The pump 102, which assists in producing a gas or air flow to the remainder of the jig 100, may deliver gas or air at a relatively constant pressure to the reservoir 104, for example. This embodiment may extend the life of the jig 100 due to the structure of the jig 100 reducing the vacillation of pressure from intermittent flow of gas through the meter 108. However, other embodiments may include variable or intermittent pressure being produced in the reservoir 104 by the pump 102.

The reservoir 104 stores air or gas supplied by the pump 102 and may have a pressure relief valve located thereon (not illustrated) for releasing excess pressure at or above a desired threshold. Such desired pressure threshold of the pressure release valve may be set by a user or may be determined according to the reservoir's 104 properties and capacity, for example. As illustrated, the reservoir 104 may be ovular in shape. However, the reservoir 104 may have any shape, size, and volume without deviating from the scope of the present disclosure. In further embodiments, the reservoir 104 may have a volume sufficient to reduce significant pressure drops in the reservoir when a relatively smaller volume of air or gas is released to the rest of the jig 100.

The adjustable orifice 106 allows for the flow of air or gas to the plenum 110 from the reservoir 104 and pump 102 to be controlled and adjusted. There can be a control to maintain the pressure above the material support unit to be plus or minus 2" water gauge, which is essentially neutral with atmospheric pressure. Also, a seal on the light material discharge or a gaslock similar to a star gate can be utilized to assist this. The adjustable orifice 106 may be any device capable of adjusting and regulating gas flow (frequency of discharge and volume of gas) and may be controlled by various means such as electronically, wirelessly, Bluetooth, or direct user contact, for example. Proximate to the adjustable orifice 106 may be a metering device 108 capable of measuring flow pressure or rate of the gas being released to the plenum 110, thereby allowing for the control of the frequency and volume of pulsations into the gas plenum 110. The metering device 108 may have outputs such as analog, digital, and audible, for example. Further, such outputs may be directly communicated to a user or may be indirectly communicated to a user through a computer. By providing relatively independent control of volume, pressure (i.e., acceleration of flow), and frequency of pulse using the meter 108 and the adjustable orifice 106, stratification and control of stratification of material on the material support unit 112 is enhanced. By producing enhanced stratification, the separation of relatively heavy material (e.g., iron) from relatively light material (e.g., coal) is also enhanced, thereby producing a more efficient jig 100.

The plenum 110 is in fluidic communication with the reservoir 104. As illustrated, the plenum 110 may have a conical shape, with a greater surface area located at the top of the plenum 110 and a smaller surface area located at the bottom of the plenum 110. However, the plenum 110 may have any shape or size without deviating from the scope of the present disclosure. Attached to the bottom of the plenum 110 may be the heavy product discharge channel 118. However, it should be appreciated that the heavy product discharge channel 118 may be located anywhere upon the plenum 110, or on the material support unit, or adjacent to the material support unit, where the lighter material cannot pass upon being stratified.

Also attached to the plenum 110 is the material support unit 112 that provides support for the heavy and light material mixture waiting to be stratified. A surface area upon which the material mixture is supported may include a plate or screen having holes there through. The material support unit 112 may be made of any material capable of supporting the material mixture, such as wood, metal, metal alloy, plastic, or any other material, for example. The material support unit 112 may also have any shape sufficient to encompass the material mixture. In one embodiment, the material support unit 112 may have a shape substantially similar, or identical, to that of the corresponding area of the plenum 110 upon which it couples. In other embodiments, the material support unit 112 may have a shape independent of the shape of the plenum 110.

The material support unit 112 also enhances the stratification of the material mixture by using movements such as rotation and pulsation, for example. The movement of the material support unit 112 may be provided by various means, including electronic, wireless, Bluetooth, or direct consumer contact, for example. The stratification of the material mixture is aided by a gaseous medium flow provided by the reservoir 104 and pump 102. In an embodiment, a pulsating gaseous medium flow provided to the mixture material periodically lifts the material to promote stratification of the mixture into a heavy material layer and a lighter material layer located atop the heavy material layer without significantly segregating or separating the materials toward the ends or sides of the material support unit 112. In a further embodiment, the plenum 110 may produce a more constant gas flow through the openings of the material support unit 112 along with a pulsating air gas flow, overlaid on the constant air flow, the pulse impacting the material mixture on the material support unit 112. As illustrated, the material support unit device 112 may be located at an angle within the jig 100. In other embodiments, the material support unit 112 may be oriented at different angles and orientations from that depicted in FIG. 1, including being directly or substantially horizontal, for example.

As illustrated, the light product discharge channel 116 is attached to the material support unit 112. However, it should be appreciated that the light product discharge channel 116 may be attached to the exterior of the plenum 110 at an area downstream from the material support unit 112 and in an area where the heavy material cannot access. Located proximate to the material support unit 112 and the light product discharge channel 116 is the discharge control device 114. The discharge control device 114 allows for the adjustable selection or control of heavy material capable of passing through the discharge control device 114 and the light product discharge channel 116. The discharge control device 114 may be controlled by any sufficient means, such as electronically, wirelessly, Bluetooth, or by direct user contact, for example. Further, the discharge control device 114 may include devices capable of determining densities of material, such as a nuclear sensor, X-ray sensor, optical sensor, or any other sensor capable of determining densities, for example. The discharge control device 114 may also include a device capable of determining thicknesses of material, such as, for example, a mechanical sensor. The discharge control device 114 may also be configured to direct the heavy material to a location separate from the light product discharge channel 116, such as the heavy product discharge channel 118. In an embodiment, the discharge control device 114 may include a device capable of automatically controlling discharge of the heavy material.

A dust collection housing 120, which manages the amount of dust released by the jig 100, may be attached to the material support unit 112 by fasteners such as screws, clamps, snaps, epoxies, resins, and seals, for example. Specific embodiment of the system may or may not have a dust collector. The dust collection housing 120 may be conical in shape, as illustrated in FIG. 1, or may be any other shape sufficient to trap dust.

A material feed-in device 122 may be proximate to the material support unit 112, and also may be proximate to the dust collection housing 120. In a further embodiment, the material feed-in device may be removably attached to the dust collection housing 120. The material feed-in device provides for replenishment of the material mixture to the material support unit 112. In so doing, the material feed-in device 122 may provide the material mixture in uniform or substantially uniform dosages, or may also provide the material variably. Such manner of replenishment may be calculated according to volume, density, or weight of the material mixture, for example. In yet another embodiment, the material feed-in device 122 may include a volume adjustment device.

Figure 2:
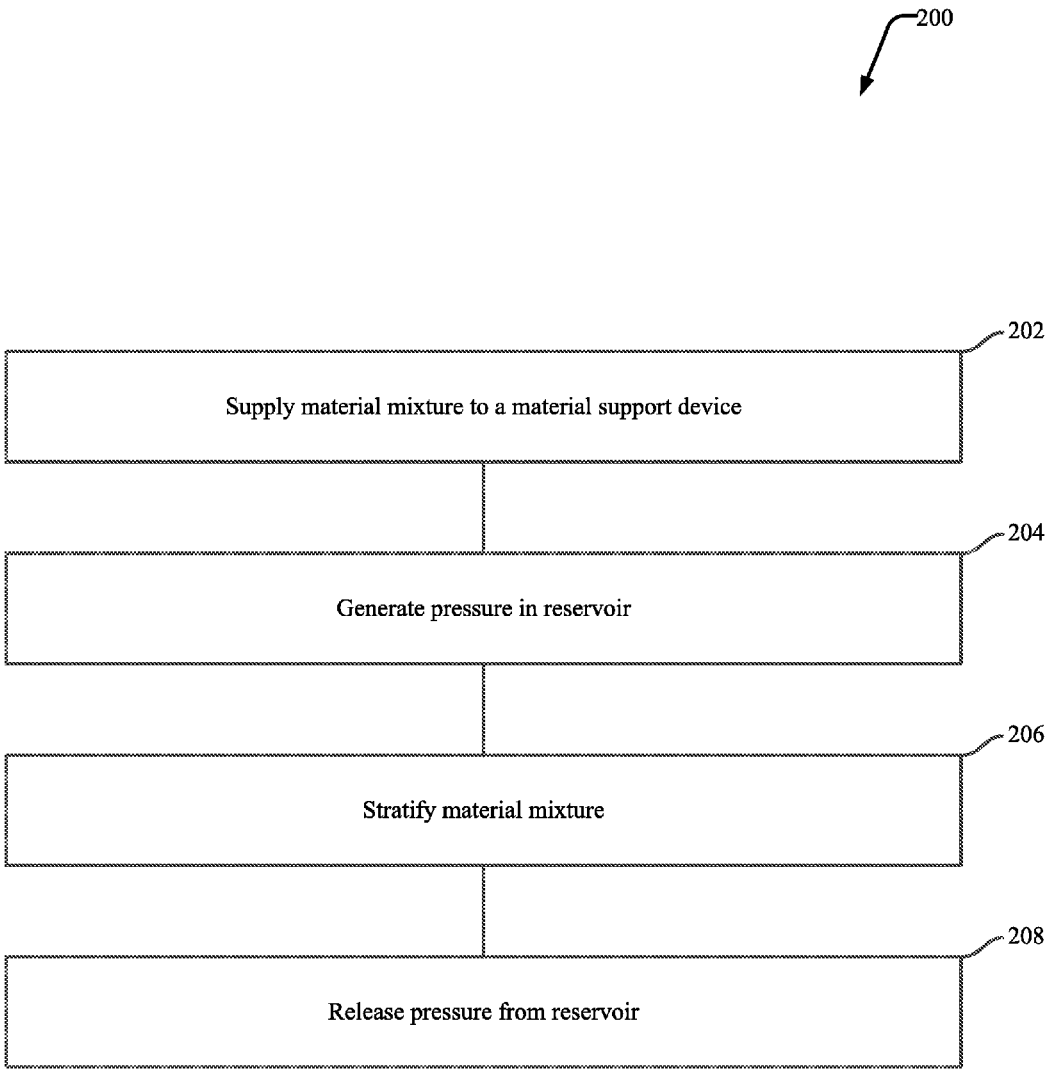
FIG. 2 is a flow diagram of embodiments of using the sifting apparatus of the present disclosure.

As seen in FIG. 2, a method 200 of using a jig according to the present disclosure is depicted. At block 202 the material support unit is supplied with a material mixture containing at least one relatively heavier material and at least one relatively lighter material. This supplying of the material mixture may occur directly or may occur through the use of a material feed-in. Supplying of the material mixture may occur at a uniform rate or may occur in variable dosages based on, for example, volume, density, and/or mass of the material mixture.

At block 204 pressure is generated in the reservoir by using the pump. The pressure generated in the pump may be set by a user of the jig, or may be determined based on the physical characteristics of the reservoir and pumping power of the pump. At block 206 the material mixture located on the material support unit may be stratified. Such stratification may occur through the use of movements such as rotation, pulsation, and/or vibration of the material support unit, for example. At block 208 gas may be released from the reservoir to the material support unit. Such release of gas may be constant, or variable, or intermittent.

In one embodiment, the release of gas from the reservoir may include releasing the entirety of the pressure, built up in the reservoir, all at once. In other embodiments of the present disclosure, the gas stored in the reservoir may be released gradually so that there always remains some pressure buildup within the reservoir. In yet another embodiment, the release of pressure from the reservoir may include releasing a constant gas flow along with a pulsating gas flow overlaid on the constant gas flow, for pulses to impact the material mixture on the material support unit.

In the operation and use, the sifting apparatus or arrangement may operate similar to other sifting apparatuses (e.g., a gravity separator) or with other sifting apparatuses. Material to be handled is fed onto a support device e.g., through a funnel, which can perform the dosing preparation of the material. Gas or air introduced constantly flows upwardly through the support device from below so as to effect a base fluidization which contributes to a loosening of the material layer lying on the material support device. The loosened material layer exhibits a reduced resistance than would be exhibited by a material layer on the material bed support device which had not been subjected to a constant air or gas flow. As a result of this sifting movement, the layers of the material bed sort themselves into the relatively heavier material layer and the relatively lighter material layer.

The present disclosure is, of course, in no way restricted to the specific disclosure of the specification and drawings, but also encompasses any modifications within the scope of the appended claims.

What is claimed is:

1. A sifting apparatus, comprising:

a material support unit being provided with only a pulsating gaseous medium flow;

a plenum attached to an underside of the material support unit;

a metering device in communication with the plenum and the material support unit, the metering device providing the pulsating gaseous medium flow to the material support unit;

a pump in communication with the metering device, wherein the pump provides a pressurized medium;

a reservoir that maintains a threshold pressure, the reservoir being positioned between the pump and the metering device; and a discharge control in communication with the material support unit and operable to control discharge of a relatively heavier material.

2. The sifting apparatus of claim 1, further comprising an adjustable orifice for adjusting a volume of the gaseous medium flow released by the metering device.

3. The sifting apparatus of claim 1, wherein the metering device controls a frequency of the pulsating gaseous medium flow provided to the material support unit.

4. The sifting apparatus of claim 1, wherein the pulsating gaseous medium flow has a pressure determined by a pressure capacity of the reservoir.

5. The sifting apparatus of claim 1, wherein the material support unit includes a base made of at least one of plastic, metal, or metal alloy.

6. The sifting apparatus of claim 5, wherein the base is a screen.

7. The sifting apparatus of claim 1, further including a material feed-in operable to feed material to the material support unit at a substantially uniform feed dosage.

8. The sifting apparatus of claim 1, wherein the discharge control includes at least one of:

means for determining densities of material; and means for determining a thickness of a layer of the relatively heavier material.

9. The sifting apparatus of claim 1, wherein the discharge control includes a device for automatically controlling the discharge of the relatively heavier material.

10. The sifting apparatus of claim 1, further comprising a dust collection housing in communication with the material support unit to prevent release of dust.

11. The sifting apparatus of claim 10 wherein the dust collection housing is coupled to the material support unit.

12. The sifting apparatus of claim 9, further comprising a light product discharge channel coupled to the discharge control.

13. A sifting apparatus, comprising:

a gravity separator having a material support unit, the material support unit being provided with only a pulsating gaseous medium flow;

a plenum attached to an underside of the material support unit;

a metering device attached to the plenum and in communication with the material support unit, the metering device providing the pulsating gaseous medium flow to the material support unit;

a pump in communication with the metering device, wherein the pump provides a pressurized medium;

a reservoir that maintains a threshold pressure, the reservoir being positioned between the pump and the metering device; and a discharge control in communication with the material support unit and operable to control discharge of a relatively heavier material.

14. A method of using a sifting apparatus comprising:

supplying, to a material support unit a mixture of a relatively heavier material and a relatively lighter material;

generating a pressure in a reservoir; and stratifying the mixture into individual layers by contacting the mixture with only a pulsating gaseous medium flow, the pulsating gaseous medium flow being released from the reservoir via the metering device, the reservoir being positioned between a pump and the metering device.

15. The method of claim 14, wherein supplying the mixture includes supplying the mixture at a substantially uniform feed dosage.

16. The method of claim 14, wherein generating the pressure includes generating the pressure in the reservoir using a constant flow rate from the pump.

17. The method of claim 14, wherein generating the pressure includes generating the pressure in the reservoir using a variable flow rate from the pump.

18. The method of claim 14, wherein stratifying the mixture includes automatically releasing the pulsating gaseous medium flow using an adjustable orifice and the metering device.

* * * * *